US005199160A

United States Patent [19]

Degenhart et al.

[11] Patent Number: 5,199,160

[45] Date of Patent: Apr. 6, 1993

[54] METHOD OF TERMINATING ELECTRICAL WINDINGS

[75] Inventors: Thomas W. Degenhart, Geneva; Russell C. Harley, Elburn; Allen Wade, Prophetstown, all of Ill.

[73] Assignee: Furnas Electric Company, Batavia, Ill.

[21] Appl. No.: 639,143

[22] Filed: Jan. 9, 1991

[51] Int. Cl.[5] ..... H01R 43/04

[52] U.S. Cl. ..... 29/605; 29/854; 336/192

[58] Field of Search ..... 29/605, 602.1, 854–856; 336/192

[56] References Cited

U.S. PATENT DOCUMENTS 4,803,454 2/1989 Umezaki ..... 336/192

*Primary Examiner*—Carl E. Hall

*Attorney, Agent, or Firm*—Wood, Phillips, Van Santen, Hoffman & Ertel

[57] ABSTRACT

The cutting or crushing of electrical wire during a tang termination process is avoided by the method that includes the steps of providing a post (28) of a thermoplastic material in adjacency to a terminal mounting structure (22, 24) wrapping an electrical conductor (34, 40) forming part of the winding (20) around the post (28), mounting a metal terminal (42) having a tang (52) on the mounting structure (22, 24) so that the tang (52) extends at least partially about the post (28), and closing the tang (52) about the post (28) with sufficient heat to destroy the insulation, if any, on the electrical conductor and establish a fused electrical connection between the tang (52) and/or terminal (42) and the conductor (34, 40).

14 Claims, 2 Drawing Sheets

METHOD OF TERMINATING ELECTRICAL WINDINGS

FIELD OF THE INVENTION

This invention relates to the termination of electrical windings as, for example, those formed about bobbins or armatures, and more specifically, to an improved tang termination.

BACKGROUND OF THE INVENTION

As more fully pointed out by Allan Warner in a writing entitled "Tang Termination Of Insulated And Bare Conductors", published in Coil Winding International, Volume 2, Issue 2 of August, 1978, the details of which are herein incorporated by reference, tang termination relates to the joining of insulated or uninsulated low resistance wires to a simple and inexpensive terminal by fusing, typically with the aid of a resistance welder. Early on, in the manufacture of small electric motors, armatures were machine wound and the lead wires inserted into slots in the commutator. The commutator was then dipped into a solder bath which burned away the insulation on the wire and joined the wires to the commutator. Unfortunately, this method was suitable only for relatively low production requirements utilizing relatively low temperature insulation systems.

As demand increased and higher temperature insulation systems became available, the first fusing method was developed to connect insulated lead wires in the slots in the commutator without the use of the solder bath. As demand continued to increase, ways were sought to eliminate the need for placing the wires into the commutator slots. Winding machines were developed to place the wires around pins or hooks to which the wires were soldered.

Soldering was ultimately eliminated through the introduction of fusing of terminal tangs. The terminals employed are normally formed from strip copper or brass and usually will have a tin plating. The tang terminal may be a part of a commutator segment, a bobbin termination system, printed circuit termination system, wire terminal or the like. Normally, the tang terminals are used with insulated, solid wire and the insulation thereon is removed during the termination process. However, tang termination methods may also be utilized with stranded or uninsulated wires.

Conventionally, the tang is somewhat "U" or "J" shaped. The wire is placed under the tang which is then mechanically closed and fused. Usually, the tang is closed simultaneously with fusing, although in some instances, the tang may be closed first so that the wires will not move as the tang and its supporting structure are moved to a fusing station.

Care must be taken to assure that the wires are not crushed by the tang during the closing or fusing process. Conventionally, the parts are heated and pushed together until all air between them is eliminated and the high points of one part are pushed into the low points of the other and vice versa. A surface adhesion contact then holds the parts together.

This contact is not a true weld, but is rather, a compression joint and its strength is not particularly great. This factor, coupled with the potential for crushing the wire, are perhaps the two greatest sources of flawed winding terminations encountered with the process.

The present invention is directed to overcoming one or more of the above problems.

SUMMARY OF THE INVENTION

It is the principal object of the invention to provide a new and improved method of tang termination of electrical windings. It is also an object of the invention to provide a new and improved tang termination structure.

According to one facet of the invention, there is provided a method of terminating a winding with a terminal which includes the steps of: a) providing a post of thermoplastic in adjacency to a terminal mounting structure; b) wrapping an electrical conductor forming part of the winding around the post; c) mounting a metal terminal having a tang on the mounting structure so that the tang extends at least partially about the post; and d) closing the tang about the post with sufficient heat to destroy the insulation, if any, on the electrical conductor and establish a fused electrical connection between the tang and/or terminals and the conductor.

According to this facet of the invention, because the post about which the conductor is wound is formed of a thermoplastic, it will soften during the heating process and will give way to prevent crushing of the wire.

In addition, because the thermoplastic softens, it actually encapsulates or pots the wire and thus acts to relieve stress at the contact point where the compression joint is formed. Consequently, a stronger connection is formed as well.

In a preferred embodiment of the invention, the step of closing the tang about the post is performed using a resistance welder.

In one preferred embodiment of the invention, the step of closing the tang is formed of two stages, the first including preheating the tang, post and electrical conductor at a low power setting and the second including the subsequent application of a high power setting for a relatively short period of time.

The invention contemplates that the tang be tinplated to enhance the fusion bond.

In a highly preferred embodiment, the step of providing a post of thermoplastic is performed by providing a thermoplastic bobbin having a side flange with a slot defining the terminal mounting structure. The post extends from the flange in close adjacency to the slot.

The invention also contemplates the use of a tang having an offset wing on at least one side thereof and which is adapted to overlie the post. The wing acts as a means to prevent the presence of a sharp edge adjacent to the wire as the tang is closed which could damage the wire.

In a highly preferred embodiment, the post in the terminal mounting structure are integral with one another and formed of the same material as, for example, by molding to eliminate any requirement of separate placement of the pins on the mounting structure.

In one embodiment of the invention, the terminal has a concave groove opening toward the post and which is adjacent the tang and nominally parallel to the direction of wrap of the electrical conductor resulting from the winding step. Should the wire tend to move as the tang is closed about the post and the wire wrapped thereon, it may enter the groove to avoid being crimped against sharp edges of the terminal.

The invention, according to another facet thereof, also contemplates an electrical winding structure which includes an armature or a bobbin, a winding of electrical wire on the armature or bobbin and a terminal mounting element on the armature or bobbin. A thermoplastic post is adjacent the mounting element and has part of the winding wrapped about and at least partially embedded therein. A metal terminal is in fused electrical contact with the winding part and is mounted to the terminal element and has a tang closed about the post.

In a highly preferred embodiment, the tang includes an elongated wing extending along one side of the tang on the side thereof closest to the winding. The wing is at an angle extending away from the post.

Preferably, the wing is integral with the tang and is bent with respect thereto at the above mentioned angle.

In a preferred embodiment, the terminal includes a base mounted to the terminal mounting element and a terminal end extending therefrom. A groove extends across the terminal between the base and a terminal end and opens toward the post and is nominally parallel to the direction of wrapping of the winding part on the post. The tang is generally parallel to the groove and located immediately adjacent thereto on the terminal side thereof.

Other objects and advantages will become apparent from the following specification taken in connection with the accompanying drawings

DESCRIPTION OF THE PREFERRED EMBODIMENT

Figure 1:
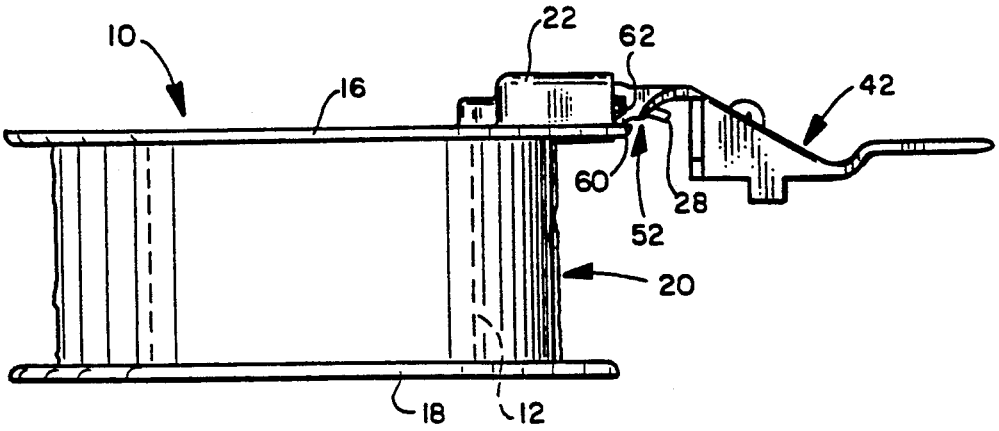
FIG. 1 is a side elevation of a magnet coil that has been tang terminated by a method according to the invention and which illustrates a tang termination structure made according to the invention.
Figure 2:
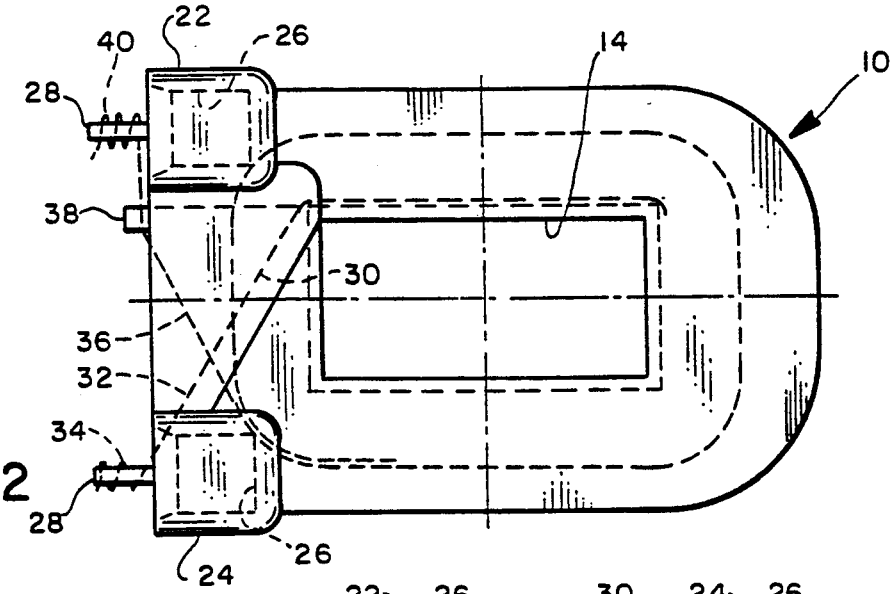
FIG. 2 is a plan view of a bobbin upon which an electrical winding may be wound with the outline of the electrical winding being shown in phantom.
Figure 3:
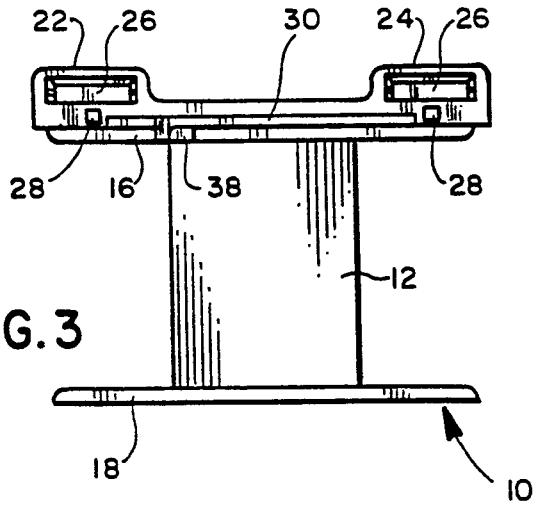
FIG. 3 is an end view of the bobbin.

An exemplary embodiment of an electrical winding made and terminated according to the invention is illustrated in the drawings and with reference to FIGS. 1-3, inclusive, is seen to include a bobbin or spool, generally designated 10, having a narrowed center 12 provided with a through passage 14 through which an armature or magnetic pole (not shown) may extend. The narrowed center 12 is flanked by spaced, opposed flanges 16 and 18 which act to confine a wire coil, generally designated 20, formed of electrically conductive wire.

Preferably, the bobbin 10 is made of a thermoplastic and any of a wide variety of thermoplastics may be utilized for the purpose so long as they have adequate insulating capabilities. As will be seen, it is also necessary that the thermoplastic utilized be such as to soften substantially at the temperatures to which it is exposed during the tang termination process.

The flange 16, adjacent one end thereof, includes a pair of terminal mounting structures 22 and 24 and as can be best seen from FIGS. 2 and 3, each such structure 22, 24 includes a slot 26 which opens to the exterior of the flange 16 in a nominally radial direction.

Centered with respect to the length of each slot 26 and also projecting in a nominally radial direction is a post 28 located on the flange 16. As can be seen in FIG. 3, the posts 28 are located between the corresponding slots 26 and the narrow centered 12 of the bobbin 10. As also can be seen in FIG. 3, each of the posts 26 of a non-round cross-section which is to say, in the specific example illustrated, of square cross-section.

As is conventional, the flange 16 also includes a diagonally extending slot 30 which extends approximately from the outer edge of the flange 16 to the narrow center 12 of the bobbin 10. The inner most end of the winding 20 is shown schematically in FIG. 2 at 32 and is disposed within the slot 30 and emerges therefrom to be wrapped around the post 28 associated with the terminal mounting structure 24. This wrap is designated 34 and is shown in phantom.

The outer end of the winding 20 is shown schematically at 36 in FIG. 2 and is looped about a short tab 38 extending from the flange 16 generally parallel to the post 28 and then wrapped as indicated schematically in phantom at 40 about the post 28 associated with the mounting structure 22. As is well-known, all of this can be performed by automatic coil winding machinery.

The non-round cross-section of the post 28 desirably prevents the wraps 34 and 40 from unwinding.

Figure 4:
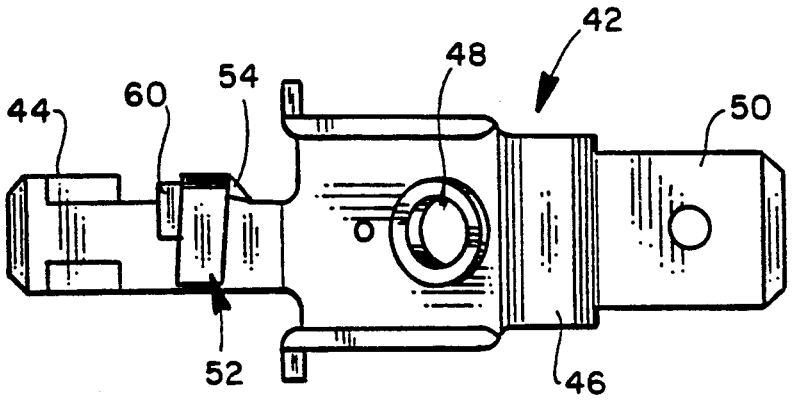
FIG. 4 is a bottom view of a terminal that may be used in practicing the invention.
Figure 5:
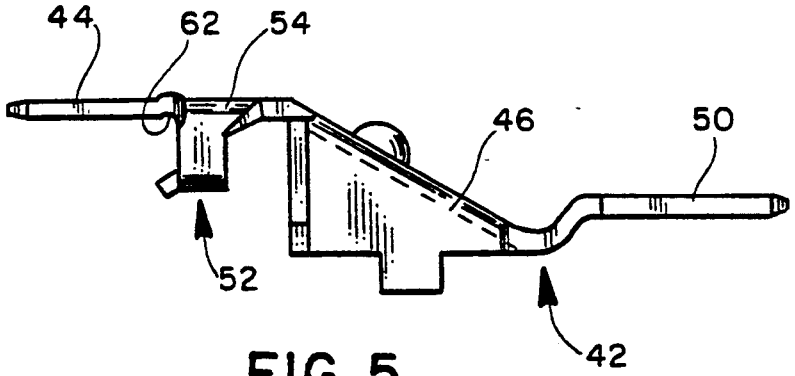
FIG. 5 is a side elevation of the terminal.

A terminal, generally designated 42, is mounted to each of the terminal mounting structures 22 and 24 as illustrated in FIG. 1. Each terminal 42, as best seen in FIGS. 4 and 5, includes a base 44 configured to enter a corresponding one of the slots 26 in a somewhat interference relationship so that the same cannot be readily removed therefrom. Oppositely of the base 44, each of the terminals 42 includes a terminal end 46. In the usual case, the terminal end will include at least one threaded opening 48 for receipt of a screw or the like (not shown) by which an electrical wire may be held in electrical contact with the terminal 42. In addition, each terminal 42 includes the male end 50 of a conventional spade connector that may be used in lieu of or in addition to the screw.

Located between the base 44 and the terminal end 46 of each terminal 42 is a tang, generally designated 52. In order to achieve the fused connection that is contemplated by the invention, it is desirable that the tang 52 be formed of a fusable metal as, for example, copper or its many alloys, silver, aluminum or the like and to inexpensively form the terminal 42, it is desirable that the tang 52 be integral therewith. Thus, the material of which the tang 52 is formed also serves as the material forming the terminal 42. Preferably, to enhance fusing in a fashion well known, each terminal 42 is tin-plated.

Figure 6:
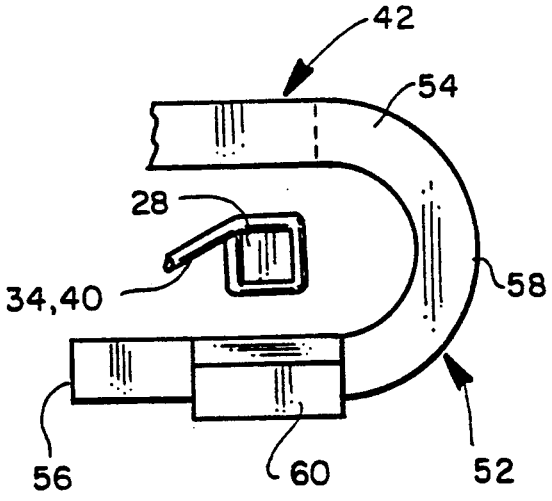
FIG. 6 is an enlarged, fragmentary side view of a tang on the terminal looking along the length of the terminal.

As perhaps best seen in FIG. 6, each tang 52 is U or J-shaped having an end 54 integral with the remainder of the corresponding terminal 42, an opposite end 56 which, prior to closing of the tang, is a free end, and an intermediate curved section 58 joining the ends 54 and 56 and also serving to space the same apart.

It will also be observed that each tang 52, between the curved section 58 and the free end 56, includes an integral, elongated wing 60. As can be seen in FIG. 1, the wing 60 is on the side of the tang 52 that is closest to the coil 20 and the mounting structure 22 or 24 and thus is on the side of the tang 52 that is closest the base 44 of the terminal 42 as well. Each wing 60 is simply a tab bent away from the remainder of the tang 52 at an angle so as to be directed away from the main body of the terminal 42 for purposes to be seen.

Figure 7:
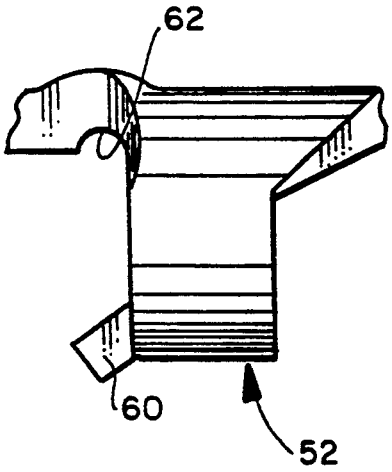
FIG. 7 is a view similar to FIG. 6, but viewing the tang in the direction across the terminal.

Located between the base 44 and the terminal end 46 of each terminal 42 and best seen in FIG. 7 is a groove 62 that opens towards the wing 60, that is, toward the free end 56 of the tang 52. The groove 62 is located between the tang 52 and the base 44 and immediately adjacent the tang 52.

After the coil has been wound on the bobbin 10 and the wraps 34 and 40 established as illustrated in FIG. 2, the terminals 42 may be inserted into each of the slots 28 in such a way that the associated tang 52 at least partially surrounds the associated post 28 and wire wrap 34, 40 thereon. This brings each wing 60 to a location whereat it underlies the corresponding post 28 and is directed away from the same as can be seen in both FIGS. 1 and 6. It also locates the length of the groove 62 generally parallel to the direction of the corresponding wrap 34 or 40 as can be appreciated from a consideration of FIG. 1.

The tangs 52 may then be closed upon the corresponding wraps 34, 40 and the post 28 on which they are wrapped through the application of pressure to the tang 52. Preferably, although not necessarily, heat is applied at the same time. The application of heat and pressure may be accomplished through the use of a conventional resistance welder utilized for the purpose such as a Joyal F/B-2, 6.75 KVA resistance welder available from Joyal Products, Inc. of Linden, New Jersey. As heat is applied, the thermoplastic of which the post 28 is formed begins to soften and the continued application of pressure allows the wraps 34, 40 to become embedded in the partially molten plastic to be essentially potted thereby. At the same time, the heat will result in a fused electrical connection between the wraps 34, 40 and the tang 52 and/or the remainder of the terminal 42. If any insulation is present on the wraps 34, 40, the heat will be sufficient so as to burn the same away to allow electrical contact to be established.

During the closing process, it will be appreciated that a sharp edge on the tang 52 cannot come in contact with the wraps 34, 40 at a location between the main part of each such wrap and the coil 20 on the bobbin 10 because of the presence of the wing 50. Consequently, crushing or nicking of the wire during closing of the tang cannot occur. In addition, because the post 28 becomes soft during the heating process, there can be no crushing of the wire against the post because the post simply gives way. Consequently, machine settings need not be crucial because the thermoplastic simply yields.

Not infrequently, as the post 28 softens during the heating process, there may be some slight shift of the wraps 34 and 40, generally in the direction of the coil 20. When such occurs, the wraps 34, 40 simply enter the groove 62 which is immediately adjacent the edge of the flange 16 and are thereby spared the possibility of being crushed.

As the closing process continues, eventually, the free end 56 will contact the remainder of the terminal 42 to signify essentially complete closing of the tang 52.

Preferably, the heating and closing occur in two stages, one of which may be characterized as a "preheat stage" and the other of which may be characterized as a "fusing stage". In the preheat stage, current will typically be flowing between the terminal 42 and the free end 56 only through the rounded section 58 whereas, by the time the fusing stage is performed, the free end 56 will be in contact with the remainder of the terminal, thereby increasing the current carrying capacity of the system.

In any event, utilizing the above-identified Joyal machine, a preheat stage of 40 cycles at 60 hertz and a power rating of 35 percent provides good results when followed by a fuse cycle stage of three cycles at 80 percent power. Once the fuse stage is completed, the assembly may be permitted to cool, it will be noted that in the usual case, the post 28 will have deformed somewhat as illustrated in FIG. 1 and will have flowed to encapsulate or pot the corresponding wrap 34, 40 to minimize stress at the compression joint between the wire and the terminal.

The invention is ideally suited for use with nonsolderable, 200° C. wire. As is well known, the service life of such wire in magnets or motors is considerably greater than that of the more conventionally used 130° or 155° C. solderable wire.

As noted previously, the use of the thermoplastic post instead of other systems including metal pins or the like or simply clamping tangs against the remainder of a terminal allows the fusion process to be performed without cutting or crushing the wire against metal components. As has been recognized, crushing or cutting of wire terminations can result in faults developing upon current surges or the like, occurrences which are highly undesirable and which usually require premature replacement of the apparatus employing the electrical winding.

The use of the integral post 28 in contrast to metal posts heretofore used eliminates the assembly step of inserting a metal pin into a bobbin flange and thereby simplifies assembly. The invention also does not require a solder dip as has been utilized in other winding termination methods.

Because but a single post is used for each wire termination, a simple winding apparatus may be utilized in lieu of more complicated winders. For example, the so-called "clothes line" wind about two spaced pins for each end termination is avoided.

The invention also provides what may be termed a universal assembly method and apparatus. For example, utilizing the Joyal machine identified previously with the specifically mentioned preheat and fuse cycles, it has been found that excellent fusion terminations with wires ranging in size from 26 through 43 can be obtained; and it is expected that satisfactory fusion connections may be obtained over an even larger range of wires. A single type of terminal such as that illustrated in FIGS. 4–7 may be used in a large variety of applications thereby minimizing production costs in that several different types of terminals do not have to be made as well as minimizing inventory.

As mentioned previously, the invention finds applicability with the use of a large or wide range of plastic materials in forming the post, although, in a preferred embodiment, the plastic used is 6—6 nylon with 33 percent glass fiber.

We claim:

1. A method of terminating a winding with a terminal comprising the steps of:

a) providing a post of thermoplastic in adjacency to a terminal mounting structure;

b) wrapping an electrical conductor forming part of said winding around said post;

c) mounting a metal terminal having a tang on said mounting structure so that the tang extends at least partially about said post; and d) closing the tang about the post with sufficient heat to destroy the insulation, if any, on the electrical conductor and establish a fused electrical connection between the tang and/or terminal and the conductor.

2. The method of claim 1 wherein step d) is performed using a resistance welder.

3. The method of claim 2 wherein step d) includes:

d1) preheating the tang, post and electrical conductor at a low power setting; and d2) thereafter, applying a high power setting for a relatively short period of time.

4. The method of claim 1 wherein step a) includes providing the post with a non-round cross section.

5. The method of claim 1 wherein at least said tang is tin plated.

6. The method of claim 1 wherein step d) is performed with sufficient heat to cause the thermoplastic of the post to at least partially flow about the electrical conductor to at least partially pot the electrical conductor.

7. The method of claim 1 wherein step a) is performed by providing a thermoplastic bobbin having a side flange with a slot defining said terminal mounting structure and wherein said post extends from said flange in close adjacency to said slot.

8. The method of claim 1 wherein step c) includes the use of a tang having an offset wing on at least one side thereof and adapted to overlie said post.

9. The method of claim 1 wherein step a) is performed using a post that is integral with the terminal mounting structure.

10. The method of claim 1 wherein step c) is formed with a terminal having a concave groove opening toward the post and adjacent said tang and nominally parallel to the direction of the wrap of the electrical conductor resulting from the performance of step b).

11. A method of providing a bobbin wound coil with at least one terminal without stripping insulation from the electrical conductor of which the coil is formed comprising the steps of:

a) providing a bobbin of a thermoplastic with spaced flanges wherein one of the flanges includes a recess in which the base of a metal terminal may be received for mounting purposes and an integral, thermoplastic post extending generally radially in close adjacency to the recess;

b) winding a coil of an electrical wire on said bobbin and wrapping a short length of the wire at one end of the coil around the post;

c) inserting the base of a metal terminal having a tang in said recess so that the tang at least partially encompasses the post and the electrical wire wrapped thereon;

d) applying pressure to the tang to close the same on the post and the electrical wire thereon; and e) applying heat sufficient to burn off the insulation, if any, on the wire wrapped around the post so that the tang and/or the terminal will make fused electrical contact with the wire.

12. The method of claim 11 wherein steps d) and e) are performed concurrently.

13. The method of claim 11 wherein step e) is performed by flowing an electrical current through the tang, first at a relatively low current level for a relatively long period of time and then at a relatively high current level for a relatively short period of time.

14. The method of claim 11 wherein steps d) and e) are performed with sufficient pressure and heat that the post softens substantially and electrical conductor is imbedded therein to become potted thereby when step e) is terminated and the post is permitted to solidify.

* * * * *